US005802820A

United States Patent [19]

Romagnoli

[11] Patent Number: 5,802,820

[45] Date of Patent: Sep. 8, 1998

[54] APPARATUS FOR OBTAINING THE UNIFORM DISTRIBUTION OF A COHESIONLESS SUBSTANCE CONTAINED WITHIN A BAG

[75] Inventor: Andrea Romagnoli, San Lazzaro Di Savena, Italy

[73] Assignee: I.M.A. Industria Macchine Automatiche S.P.A., Emilia, Italy

[21] Appl. No.: 750,058

[22] PCT Filed: Apr. 2, 1996

[86] PCT No.: PCT/IT96/00064

§ 371 Date: Dec. 4, 1996

§ 102(e) Date: Dec. 4, 1996

[87] PCT Pub. No.: WO96/31398

PCT Pub. Date: Oct. 10, 1996

[30] Foreign Application Priority Data

Apr. 4, 1995 [IT] Italy ..... BO95A0149

[51] Int. Cl.[6] ..... B65B 1/22

[52] U.S. Cl. ..... 53/525; 53/134.2; 53/540; 53/527; 53/529

[58] Field of Search ..... 53/134.2, 540, 53/527, 525, 526, 529, 542, 544, 313; 493/317, 318, 311, 315; 100/177, 178, 223; 414/754, 758

[56] References Cited

U.S. PATENT DOCUMENTS

| | | | |
|---|---|---|---|
| 3,812,643 | 5/1974 | Vergobbi | 53/540 |
| 4,288,224 | 9/1981 | Romagnoli | 53/134.2 |
| 4,382,355 | 5/1983 | Romagnoli | 53/134.2 |
| 5,060,450 | 10/1991 | Greenwell et al. | 53/113 |
| 5,331,790 | 7/1994 | Benner, Jr. et al. | 53/113 |

FOREIGN PATENT DOCUMENTS

| | | |
|---|---|---|
| 1 001 944 | 1/1957 | Germany . |
| 39 21 538 | 3/1991 | Germany . |
| BO95A 000148 | 4/1995 | Italy . |
| 1 097 842 | 1/1968 | United Kingdom . |
| 2 135 649 | 9/1984 | United Kingdom . |

*Primary Examiner*—Daniel Moon
*Assistant Examiner*—John Paradiso
*Attorney, Agent, or Firm*—IP Group of Pillsbury Madison & Sutro LLP

[57] ABSTRACT

Between a machine that manufactures bags of variable volume containing cohesionless material (exemplified by tea bags), and a packing machine which packs the bags as stacks, an indexing rotor with pockets in its outer periphery acts, in cooperation with a loading mechanism and an unloading mechanism at respective angularly distributed stations, at which each bag is respectively oriented bottom down and bottom up, to tend to redistribute the cohesionless material away from each bag bottom and to cause individual bags to be generally equally thick relative to one another.

11 Claims, 1 Drawing Sheet

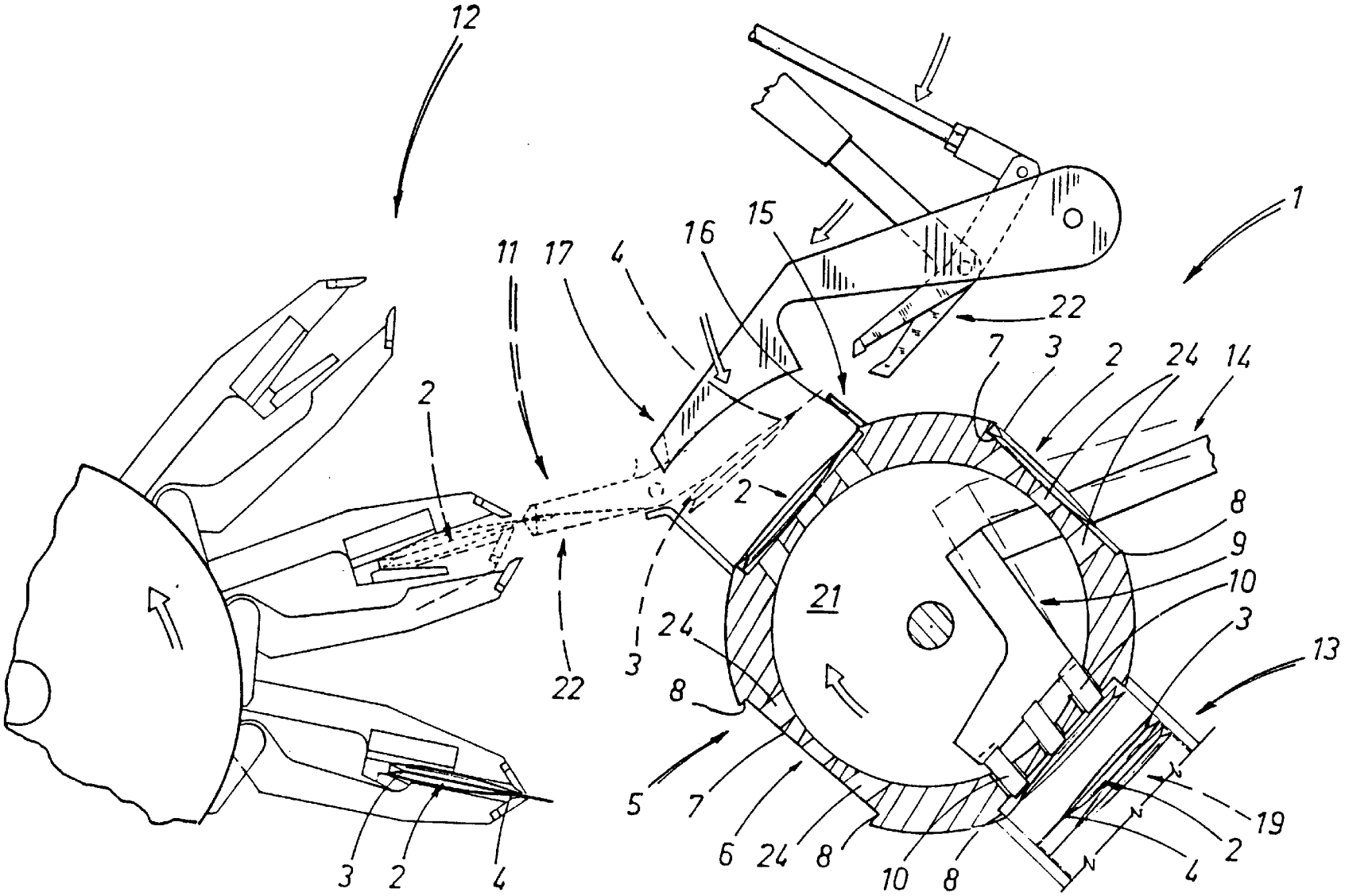
1
13
14
19
2
4
24
8
9
10
3
22
7
15
16
21
6
5
17
11
12

APPARATUS FOR OBTAINING THE UNIFORM DISTRIBUTION OF A COHESIONLESS SUBSTANCE CONTAINED WITHIN A BAG

This application is the national phase of international application PCT/IT96/00064 filed Apr. 2, 1996 which designated the U.S.

TECHNICAL FIELD

The present invention relates to an apparatus by means of which to obtain the uniform distribution of a cohesionless substance contained within a bag presenting a useful internal volume of variable geometry compassed between a bottom end and a closured top end.

Such an apparatus is especially of service in machines for the manufacture of filter bags containing a substance with which to prepare an infusion, typically tea or herbal powders, and in particular, bags with a closure fashioned in such a way as to avoid glued or heat-sealed parts dictating the presence of a layer of adhesive that could occasion the migration of undesirable elements when the bag is immersed in a hot liquid to prepare the infusion.

BACKGROUND ART

Because bags of the type in question exhibit an overall shape of essentially non-homogeneous character, however, the substance encounters resistances to free flow internally of the useful internal volume of the bag that will vary from one part of the bag to another, causing localized accumulations of the substance which tend to favored certain areas at the expense of other more inaccessible areas.

It follows from the foregoing that the dimensions of a filter bag filled with cohesionless substances of the type being discussed will appear enlarged in certain typical areas, and that a finished pack can therefore be unreasonably penalized in terms of size: this is especially true in the conventional double folded type of bag, since the effects of a non-uniform distribution are produced twice over.

This drawback reflects just one aspect of the problems affecting industrial manufacture generally, not the least of which is the current need to bring about increasingly severe reductions in the quantity of materials used for packaging and wrapping consumer products, to the end of limiting their impact on the environment and saving the energy resources employed in disposing of such materials as waste.

Notwithstanding the fact that machines of more recent embodiment have been designed to perform operations such as will enable the infusionable substance to distribute itself in as uniform a manner as possible internally of the bags, a certain degree of irregularity in distribution is inevitable and will be more evident especially when bags are assembled and packaged in a significant number, so that the dimensions of the finished packs tend still to be somewhat considerable.

SUMMARY OF THE INVENTION

The object of the invention, is to overcome the drawbacks in question by providing an apparatus such as will bring about the uniform distribution of a cohesionless substance contained internally of a bag presenting a useful internal volume of variable geometry.

The stated object is realized in an apparatus comprising a rotor that provides at least one pocket, proportioned to accommodate a single bag, of which the surface supporting the bag is disposed substantially tangential to the rotor and delimited by transversely disposed walls. The rotor can be indexed through a given angular distance, from a position in which a bag is transferred into the pocket, to a knockout position in which the bag is ejected from the pocket, in such a way that the closured top of the bag locates against the corresponding transverse wall as the movement of the rotor is interrupted at the latter position, and the substance within the bag is caused forcibly to shift from the bottom toward the closured top.

The apparatus according to the invention is therefore able to overcome the problem inherent in obtaining a uniform distribution of the substance within the bag, this being a fundamental prerequisite if the dimensions of finished packs are to be contained.

In practice, the solution disclosed offers the facility of controlling the movement of the rotor in such a way that the substance will be subjected to forces of inertia of an intensity best able to bring about the uniform distribution internally of the bag, bearing in mind both its intrinsic flow characteristics, of which the thermal and hygrometric parameters may vary from batch to batch, and the effective geometry of the bags during manufacture.

A further advantage of the invention is discernible in the possibility of achieving a synergical combination with production machines of conventional type, or with a machine as disclosed in Italian patent application B095A 000148.

Indeed, by positioning the apparatus disclosed between an outfeed station of the machine and a station at which the finished bags are assembled for wrapping, it becomes possible to control the uniform distribution of the substance within each bag even more accurately.

The arrangement of the apparatus and the machine one in relation to the other as described above will also allow the inclusion of a reject station, located along the path of the rotor at a point between the transfer and knockout positions, from which to discard substandard bags.

Accordingly, if a bag is found to be defective, having been identified as such by detection sensors with which the production machine will normally be equipped throughout, it can be eliminated as the rotor pauses at the reject station.

The advantage provided by such an arrangement is yet more evident when considering that in a conventional machine such as that disclosed in DE 1 001 944, the detection of one defective bag results in the need to reject the entire pack of which the substandard bag forms a part.

BRIEF DESCRIPTION OF THE DRAWING

The invention will now be described in detail, by way of example, with the aid of the single accompanying drawing, in which:

The sole figure is a schematic elevation that illustrates the apparatus according to the invention in association with a manufacturing machine, which is indicated only in part.

With reference to the accompanying drawing, the present invention consists substantially in an apparatus 1 designed to bring about the uniform distribution of a cohesionless substance contained in a bag 2 of which the useful internal volume, delimited so as to be between a bottom 3 and a closured top 4, is of variable geometry.

The apparatus 1 is associated with a machine 12 for the manufacture of filter bags 2 containing a product with which to prepare an infusion, and occupies a position between an outfeed station 11, at which the bags 2 are removed singly from the machine 12 by a conventional gripper mechanism 22, and an assembly station 13 at which the bags 2 are stacked in a single stack and thus ordered into a pack 19.

More exactly, and as discernible from the accompanying drawing, the apparatus 1 substantially comprises a rotor 5 providing a plurality of pockets 6 each proportioned to admit a single bag 2, which are spaced apart one from the next by an angular distance that corresponds to one full revolution divided by the number of pockets; in the example illustrated, the pockets 6 are four in number and therefore are spaced apart at 90° one from another. Each pocket 6 provides a surface 7 on which the bag 2 is supported, disposed substantially tangential to the rotor 5 and delimited by transversely disposed and substantially radial walls 8.

The rotor 5 can be driven intermittently in rotation and is able thus to index through steps of 90° from a position at which a bag 2 is transferred into a respective pocket 6 by the action of the gripper 22, to a knockout position, separated from the transfer position preferably by an angle of 180°, at which the bag 2 is distanced from the pocket 6 and directed toward the assembly station 13.

By reason of the fact that the rotor 5 is set in motion intermittently, it happens that upon arrival at the knockout position the bag 2 is thrown forward by the arresting action, with the result that the closured top 4 locates against the corresponding transverse wall 8 of the respective pocket 6 and the contents are caused forcibly to shift inside the bag 2 through the effect of inertia, redistributing away from the bottom 3 and toward the closured top 4, hence toward the end of the bag that the substance would normally find less easy to fill.

It will be noted also that in passing from the transfer position to the knockout position the filter bag 2 moves from an initial orientation to an exactly opposite orientation. In a preferred solution, the relative positioning of the outfeed station 11, the apparatus 1 and the assembly station 13 will be such that, upon reaching the knockout position, the single bag 2 is disposed with the closured top 4 directed downwards. Accordingly, the force of inertia generated by the tangential acceleration of the rotor 5 is compounded by the force of gravity, favoring a more penetrative flow of the substance toward the top 4 and in effect a successful distribution of the substance within the bag.

As illustrated in the drawing, the machine 12 further comprises means 15, 16 and 17 by which to place each filter bag 2 in the pocket 6 of the rotor 5 currently occupying the transfer position.

In a preferred embodiment of the apparatus, the placing means comprise a fixed tubular duct 15 oriented substantially in a radial direction, relative to the rotor 5, and disposed in such a way as to enable its association with the different pockets 6 during the indexing movement of the rotor as these are brought one by one into the position at which the bags 2 are transferred.

The duct 15 provides a rigid guidance wall 16 against which the closured top 4 of the transferred bag 2 is caused to strike when released during the swinging movement of the gripper 22, with the result that the contents begin moving toward the top 4 even before the bag 2 has come fully into contact with the rotor 5.

Advantageously, the placing means further comprise a compactor 17 such as can be associated with the duct 15 and caused to alternate between an inactive position, occupied when a single filter bag 2 is admitted to the duct 15, and an active position in which pressure is applied to flatten the bag 2 against the pocket 6 of the rotor 5.

Also forming a part of the apparatus 1 are ejection means 9, 10 by which each bag 2 is removed forcibly from the respective pocket 6 of the rotor 5 at the knockout position.

In the example illustrated, such ejection means comprise actuator elements 10 designed to associate with the pocket 6 and capable of movement from an inactive position, concealed behind the surface 7 that supports the bag 2, to an active position inserted through and projecting from the supporting surface 7 in such a way that the bag 2 is pushed clear of the pocket 6.

The apparatus comprises just one set of ejection means 9 and 10 serving all the pockets 6 of the rotor 5 and, with a rotor 5 of tubular embodiment, will be accommodated within the hollow bore 21 in such a way as to interact with each of the pockets in turn, as these are brought into the knockout position, passing through special interconnecting holes 24 afforded by the wall of the rotor 5.

The function of the assembly station 13 (which requires no further description, being conventional in embodiment) is to keep the pack 19 of bags 2 tightly compacted as formation proceeds.

To advantage, the apparatus 1 is associated with the machine 12 in such a way as to allow of including a reject station 14 from which any defective bags 2 may be discarded. In this instance, the reject station 14 is located between the outfeed station 11 and the assembly station 13 in such a way as to exploit the pause punctuating the movement of each pocket 6 from the one station to the other. If, at the same time as the rotor 5 moves between the transfer position and the knockout position, a signal is received from sensors in the machine 12 indicating the arrival of a substandard bag 2, then the pause at the reject station 14 can be utilized to bring about the elimination of the defective bag 2.

I claim:

1. Apparatus for uniformly distributing a cohesionless substance contained in a bag having an internal volume of variable geometry delimited between a bottom and a closured top of the bag, comprising:

a rotor having a radially outer periphery relative to a longitudinal rotational axis which is arranged so as to be substantially horizontal, the rotor being arranged to be intermittently rotated about said axis and abruptly stopped in respective steps each of a respective predetermined angular extent;

said rotor being provided in said outer periphery with at least one pocket, each said pocket being arranged to receive at any time a total of one said bag; each pocket being delimited by a supporting surface which is disposed so as to be generally tangential to said outer periphery of said rotor, and opposite delimited angularly of said outer periphery by two transversely disposed walls which are disposed so as to extend generally radially of said rotor, with one of said walls being an angularly leading wall relative to the respective pocket;

an outfeed station and a knockout station juxtaposed with said rotor at two respective positions which are spaced from one another such that each confronts a said at least one pocket when said rotor is stopped between respective ones of said steps of intermittent rotation of said rotor, and such that, a said bag if installed in a said pocket bottom side down at said outfeed station becomes oriented bottom side up when ready to be ejected from the respective pocket at said knockout station;

the positioning of the angularly leading one of said walls of each pocket being such as to co-act with the force of gravity when the rotor abruptly stops as a respective pocket carrying a respective bag with its closured top angularly leading, is brought into confirmation with the knockout station, on the respective bag to redistribute the cohesionless substance within the respective bag relatively away from the bottom of the respective bag and towards the top of the respective bag.

2. The apparatus of claim 1, wherein:

said at least one pocket is constituted by a plurality of like pockets which are equiangularly distributed about said longitudinal axis of said rotor.

3. The apparatus of claim 1, further comprising:

knockout station for ejecting respective bag from the respective pocket of the rotor at said knockout station.

4. The apparatus of claim 3, wherein:

said rotor is provided as a tubular structure.

5. The apparatus of claim 4, wherein:

each said pocket is provided with at least one opening therethrough; and each said ejector is arranged within said rotor and has at least one actuator element which is arranged for movement between a retracted, inactive position concealed internally of the rotor, and an extended active position protruding into the respective pocket through the respective at least one opening in the respective said pocket.

6. The apparatus of claim 5, wherein:

said at least one ejector is constituted by only one ejector.

7. The apparatus of claim 1, further comprising:

a device for placing a bag in each said pocket when that pocket is disposed in confronting relation to said outfeed station.

8. The apparatus of claim 7, further comprising:

a machine for assembling said bag, in plurality, in succession and for serving such bags, each containing said cohesionless substance, in succession to said device, for successive placement by said device each in a respective said pocket.

9. The apparatus of claim 7, wherein:

said placing device includes a tubular duct arranged to extend substantially radially of said rotor and to have a rigid guidance wall oriented to be struck by each bag when being inserted therethrough into a respective pocket at said outfeed station in such a way as to tend to cause said cohesionless substance as contained in the respective bag to shift relatively away from the bottom and towards the closured top of the respective bag.

10. The apparatus of claim 1, wherein:

said rotor has four said pockets, which are equiangularly distributed about said longitudinal axis; and further comprising a reject station disposed in confronting relation to said periphery of said rotor equiangularly between said outfeed station and said knockout station, and arranged to permit a defective said bag, when paused in a respective said pocket disposed in confronting relation to said reject station, to be rejected from the respective pocket.

11. The apparatus of claim 9, wherein:

said placing device further includes a compactor arranged to engage a respective bag being introduced through said tubular duct into a respective pocket, against the respective said support surface of the respective said pocket.

* * * * *